US006413412B1

(12) United States Patent
Peng et al.

(10) Patent No.: US 6,413,412 B1
(45) Date of Patent: Jul. 2, 2002

(54) PROCESS FOR PRODUCING DIESEL OILS OF SUPERIOR QUALITY AND LOW SOLIDIFYING POINT FROM FRACTION OILS

(75) Inventors: Yan Peng; Xianglan Meng; Weiping Fang; Lixiu Zhang; Lizhi Liu, all of Liaoning (CN)

(73) Assignees: China Petrochemical Corporation, Beijing; Fushun Research Institute of Petroleum and Petrochemicals, Sinopec, Liaoning Province, both of (CN)

( * ) Notice: Subject to any disclaimer, the term of this patent is extended or adjusted under 35 U.S.C. 154(b) by 0 days.

(21) Appl. No.: 09/459,912

(22) Filed: Dec. 14, 1999

(30) Foreign Application Priority Data

Dec. 16, 1998 (CH) ..... 98121075
Sep. 29, 1999 (CH) ..... 99113293

(51) Int. Cl.[7] ..... C10G 65/02
(52) U.S. Cl. ..... 208/89; 208/27; 208/58; 208/60; 208/216 R; 208/217
(58) Field of Search ..... 208/89, 27, 58, 208/60, 216 R, 217

(56) References Cited

U.S. PATENT DOCUMENTS 4,153,540 A * 5/1979 Gorring et al. ..... 208/89
4,394,249 A * 7/1983 Shea ..... 208/89
4,436,614 A * 3/1984 Olbrich et al. ..... 208/89
4,810,356 A * 3/1989 Grootjans et al. ..... 208/59
4,913,797 A * 4/1990 Albinson et al. ..... 208/89
4,917,789 A * 4/1990 Butler et al. ..... 208/89
5,277,794 A * 1/1994 Delaney et al. ..... 208/143
5,358,627 A * 10/1994 Mears et al. ..... 208/59
5,906,729 A * 5/1999 Chou ..... 208/89
5,935,414 A * 8/1999 Sonnemans et al. ..... 208/58
6,103,101 A * 8/2000 Fragelli et al. ..... 208/89

* cited by examiner

*Primary Examiner*—Walter D. Griffin
(74) *Attorney, Agent, or Firm*—Birch, Stewart, Kolasch & Birch, LLP

(57) ABSTRACT

This invention discloses a single-stage process for producing diesel oils of superior quality and low solidifying point from fraction oils under controlled reaction conditions, comprising a hydrorefining step, optionally a hydroupgrading step and a hydrodewaxing step combined in series. The process of the invention is simplified, the operation is simple, the adaptability to feedstocks is good, and the quality of diesel oil product is improved, and when the hydroupgrading step is comprised, the cetane number of the product is further boosted. A hydrorefining catalyst having a higher content of NiO and good anti-coking performance and a hydroupgrading catalyst and hydrodewaxing catalyst having an adequate acidity and strong resistance to $NH_3$ and $H_2S$ respectively are preferably used in the present invention to achieve better results.

22 Claims, No Drawings

PROCESS FOR PRODUCING DIESEL OILS OF SUPERIOR QUALITY AND LOW SOLIDIFYING POINT FROM FRACTION OILS

FIELD OF THE INVENTION

The present invention relates to a process for producing diesel oils, more particularly, to a process for producing diesel oils of superior quality and low solidifying point from fraction oils of inferior quality.

BACKGROUND OF THE INVENTION

In recent years, fraction oils are becoming more and more inferior in quality as the raw oils are becoming worse in quality, and the processing of heavy and/or residual oils is becoming deeper and deeper, and the like, and moreover, stricter requirement for quality of the products shall be met according to the relevant environmental protection laws. Therefore, it needs urgently to find a new technological process suitable for producing diesel oils of superior quality from fraction oils of inferior quality.

At present, a conventional process for treating fraction oils of inferior quality is a hydrorefining process, which is low in the technological investment and mature in technique, and is an important means widely used in the industry for improving the quality of oil products. The catalyst commonly used in the hydrorefining process comprises 10–25 wt % of $MoO_3$ (or $WO_3$) and 3–5 wt % of NiO (or CoO) supported on $\gamma$-$Al_2O_3$ as carrier. However, this process has a disadvantage that the solidifying point of diesel oils cannot be effectively reduced to produce diesel oils of superior quality.

On the other hand, a hydrodewaxing process can provide oil products of low solidifying point by selectively cracking the constituents having high solidifying point, such as paraffins, alkanes with short branched chains, naphthenes with long branched chains and the like, in feedstocks, into small molecules under the conditions at a given temperature and hydrogen partial pressure and using a molecular sieve catalyst having unique pores and adequate acid sites. However, the product obtained by the process has the disadvantages of high sulfur content and poor stability, therefore it does not meet the new standards for diesel oil products. In addition, the catalyst for the hydrodewaxing process has only weak activity for hydrogenation, so, when used for treating fraction oils of inferior quality, the catalyst is deactivated by the poisonous impurities contained in feedstocks at a relatively fast rate and consequently the service life of the catalyst becomes shorter.

U.S. Pat. No. 4,436,614 teaches a process for producing base oils of lubricating oils or middle fraction oils of low solidifying point from fraction oils, comprising a single-stage technological process of desulfurization combined in series with dewaxing, wherein the desulfurization reaction of hydrocarbon feedstocks having a distillation range of 200–600° C. is carried out over a desulfurizing catalyst on the upper bed of a reactor while an inert diluting gas is introduced into the reactor to reduce the hydrocarbon gas partial pressure to 0.2 MPa, and the dewaxing reaction is carried out over a molecular sieve type of nonhydrodewaxing catalyst on the lower bed of the same reactor under a hydrocarbon gas partial pressure of less than 0.2 MPa. The dewaxing reaction occurring in the lower part of the reactor belongs to nonhydrodewaxing reaction carried out in absence of hydrogen, and the catalyst used contains no hydrogenation components, so the olefins and nonhydrocarbons in the feedstock cannot be saturated by the dewaxing reaction. Especially, as a large amount of olefins is formed in the nonhydrodewaxing process, the colour of the products consequently becomes darker. Therefore the product obtained by the nonhydrodewaxing process has poor stability, and since a large quantity of coked deposits is formed in the catalytic process of non-hydrodewaxing, the running period of the catalyst is shortened significantly.

U.S. Pat. No. 4,743,354 discloses a process for converting a waxy hydrocarbon feedstock into lube oils or diesel oils having a reduced content of normal paraffins by using a single-stage process of a catalytic dewaxing step combined with a hydrocracking step in series, in which the feedstock is reduced in the dewaxing step by selectively converting waxy paraffins into lower molecular weight hydrocarbons, and at least a portion of the effluent from the dewaxing zone is then passed to a hydrocracking zone where it is further cracked to produce with a comparatively high yield lube oils or diesel oils having a low normal paraffin content. When the desired product is a lube oil, the overall conversion to components boiling at or below about 343° C. is no more than 20 vol %, preferably 10 vol %; and when the desired product is a diesel oil, the overall conversion to components boiling below about 149 C. is no more than 25 vol %, preferably 15 vol %. It is also mentioned in the patent that a single-stage process of hydrotreating, hydrodewaxing combined with hydrocracking in series may be used for treating some feedstocks of inferior quality to produce the objective products. However, where the process is used for producing diesel oils of superior quality, the hydrorefined feedstock is subjected to hydrodewaxing reaction and results in forming some alkenes, which will be saturated in the subsequent hydrocracking reaction, and subsequently will compete with and bring about adverse effects on the saturation of aromatics and the ring-opening reactions, thus the cetane number of the product can not be boosted effectively. In addition, the patent only teaches in general that the process can produce a comparatively high yield of products having a lower solidifying point, without mentioning other properties showing the product quality and examples, and the catalysts used in this patent are not specifically defined.

U.S. Pat. No. 4,664,775 relates to a method by using a catalyst comprising a zeolite TSZ for manufacturing a low pour point petroleum product, such as the insulating oil, the lubricating oil used for various types of solidifying devices, or the base oil for such lubricating oil, from a paraffin-based crude oil as the starting material. In one embodiment of the process, the raw oil is at first catalytically dewaxed, then distilled, and then the fractions boiling at more than 288° C. are hydrorefined, and the stream is then separated in a distillation system to obtain the objective products. In a second embodiment of the process, the raw oil is at first catalytically dewaxed, and then hydrorefined, and the stream is then separated in a fractionating system to obtain products boiling at more than 288° C. In a third embodiment of the process, the raw oil is at first hydrorefined, then separation of liquid from gas is carried out in a separating system, and the stream is then catalystically dewaxed, and distilled to obtain products boiling at more than 288° C. All these embodiments of the process involve a complicated two-stage process, and when practically used in industry, it is inconvenient to operate and the production costs and investment in the process are high.

Therefore, there is a need in the art to develop a simple and feasible process convenient to operate for producing diesel oils which meet the new standards for diesel oils.

DISCLOSURES OF THE INVENTION

The object of the present invention is to overcome the technical problems existing in the prior art and to develop a simple and feasible process for producing diesel oils of superior quality and low solidifying point from fraction oils of inferior quality, and the product obtained has an improved quality and can meet the new standards for diesel oil products, and can even achieve a cetane number boost.

After extensive studies and experiments, the inventors have developed a practicable single-stage process comprising a hydrorefining step and a hydrodewaxing step combined in series. And when necessary, the process may optionally comprise a further hydroupgrading step between the two steps. That is, the process comprises a hydrorefining step, optionally a hydroupgrading step, and a hydrodewaxing step combined in series. In order to simplify the apparatus and make operation easier, when the process is used in industrial production, the hydrorefined feedstocks can be hydrodewaxed directly, or first hydroupgraded and then hydrodewaxed, without any further steps of heat exchanging and removing $NH_3$ and $H_2S$ formed in the course of reaction between these steps.

Under the controlled reaction conditions, the process of the present invention can provide products having an improved quality which meets the new standards for diesel oil products, and even having a boosted cetane number. Since the controlled reaction conditions are applied, the process of the present invention needs no further steps of heat exchanging and removing $NH_3$ and $H_2S$ formed in the reaction after the feedstocks are hydrorefined and optionally hydroupgraded. That is, the hydrorefining step, the optional hydroupgrading step and the hydrodewaxing step are combined directly in series, thus the investment in apparatus for carrying out the process is reduced and the processing steps are simplified.

Furthermore, better results can be achieved when the following technical problems are solved: (1) after the feedstocks are hydrorefined in the hydrorefining section, a large amount of $NH_3$ and $H_2S$ gas is formed, and the stream containing $NH_3$ and $H_2S$ will inevitably affect the activity and service life of the catalysts used in the subsequent step(s), so the hydroupgrading catalyst and the dewaxing catalyst to be used should better be selected so that they have good resistance to $NH_3$ and $H_2S$, namely, good activity and stability in the presence of $NH_3$ and $H_2S$; (2) the reaction temperatures in the hydrorefining section, the optional hydroupgrading section and the dewaxing section should match well with each other. In the running of the process, the gradual deactivation of the catalyst in the dewaxing section should be compensated by raising the temperature. Because there is no heat exchanging step between these sections, it needs to raise the reaction temperature in the hydrorefining section and the optional hydroupgrading section to meet the temperature requirement of the dewaxing section. Hence, it requires synchronous temperature elevation in the two or three sections and synchronous deactivation of the catalysts used therein. Therefore, better results will be achieved, if the catalysts used can meet the specific requirements, that is, with respect to the hydroupgrading catalyst and hydrodewaxing catalyst, it is required to have adequate acidic property to enhance the catalyst's resistance to $NH_3$ and $H_2S$; and with respect to the hydrorefining catalyst and hydroupgrading catalyst, it is required to exhibit good performances, especially an excellent anti-coking ability and stability at an elevated temperature. The inventors have found some catalysts having excellent properties mentioned above, and when such preferred catalysts are used in the preferred embodiments of the present invention, better results are achieved.

Accordingly, the process of the present invention comprises the steps of:

(1) hydrorefining the feedstocks over a hydrorefining catalyst in the presence of hydrogen under appropriate reaction conditions, and (2) hydrodewaxing directly the effluent from the step (1) over a hydrodewaxing catalyst in the presence of hydrogen under appropriate reaction conditions.

In the above step (1), the reactions of hydrodenitrogenation, hydrodesulfurization, hydrosaturation of aromatics and the like are carried out; and in the above step (2), the hydrodewaxing catalyst is capable of effectively promoting the dewaxing reaction under the reaction conditions whereby a shape cracking reaction occurs mainly to remove the waxy constituents.

More particularly, the operation conditions of the hydrorefining step are controlled as follows: reaction temperature: 300–420° C., preferably 320–400° C., and more preferably 340–380° C.; hydrogen partial pressure: 2.0–8.0 MPa, preferably 3.0–7.0 MPa, and more preferably 4.0–6.0 MPa; $H_2$/oil volume ratio: 200–1000, preferably 400–900, and more preferably 500–800; and liquid hourly space velocity (LHSV): 0.5–5.0 $h^{-1}$, preferably 0.8–4.0 $h^{-1}$, and more preferably 1.0–3.0 $h^{-1}$. The operation conditions of the hydrodewaxing step are controlled as follows: reaction temperature: 300–430° C., preferably 320–410° C., and more preferably 340–390° C.; hydrogen partial pressure: 2.0–8.0 MPa, preferably 3.0–7.0 MPa, and more preferably 4.0–6.0 MPa; $H_2$/oil volume ratio: 200–1000, preferably 400–900, and more preferably 500–800; and liquid hourly space velocity: 0.2–5.0 $h^{-1}$, preferably 0.5–4.0 $h^{-1}$, and more preferably 0.8–3.0 $h^{-1}$.

The hydrorefining step and the hydrodewaxing step can be carried out respectively either on two beds in one reactor, or in two reactors combined in series.

In order to further boost the cetane number of the obtained products, the process of the present invention may comprise a further hydroupgrading step between the two steps mentioned above, therefore, an embodiment of the process of the present invention comprises preferably the steps of:

(1) hydrorefining the feedstocks over a hydrorefining catalyst in the presence of hydrogen under appropriate reaction conditions, (2) hydroupgrading directly the effluent from the step (1) over a hydroupgrading catalyst in the presence of hydrogen under appropriate reaction conditions, and (3) hydrodewaxing directly the effluent from the step (2) over a hydrodewaxing catalyst in the presence of hydrogen under appropriate reaction conditions.

In the above step (1), the reactions of hydrodenitrogenation, hydrodesulfurization, hydrosaturation of aromatics and the like are carried out. In the above step (2), the hydroupgrading catalyst is capable of promoting the reactions of hydrodenitrogenation, hydrodesulfurization, hydro-saturation of aromatics and selective ring-opening under the reaction conditions, whereby effectively boosting the cetane number. And in step (3), the hyrodewaxing catalyst is capable of effectively promoting the dewaxing reaction under the reaction conditions whereby a shape cracking reaction occurs mainly to remove the waxy constituents.

More particularly, the operation conditions of the hydrorefining step are controlled as follows: reaction temperature: 300–420° C., preferably 320–400° C., and more preferably 340–380° C.; hydrogen partial pressure: 2.0–8.0 MPa, preferably 3.0–7.0 MPa, and more preferably 4.0–6.0 MPa; $H_2$/oil volume ratio: 200–1000, preferably 400–900, and more preferably 500–800; and liquid hourly space velocity (LHSV): 0.5–5.0 $h^{-1}$, preferably 0.8–4.0 $h^{-1}$, and more preferably 1.0–3.0 $h^{-}$. The operation conditions of the hydroupgrading step are controlled as follows: reaction temperature: 320–430° C., preferably 340–410° C., and more preferably 350–390° C.; hydrogen partial pressure: 2.0–8.0 MPa, preferably 3.0–7.0 MPa, and more preferably 4.0–6.0 MPa; $H_2$/oil volume ratio: 200–1000, preferably 400–900, and more preferably 500–800; and liquid hourly space velocity: 0.5–5.0 $h^{-1}$, preferably 0.8–4.0 $h^{-1}$, and more preferably 1.0–3.0 $h^{-1}$. The operation conditions of the hydrodewaxing step are controlled as follows: reaction temperature: 300–430° C., preferably 320–410° C., and more preferably 340–390° C.; hydrogen partial pressure: 2.0–8.0 MPa, preferably 3.0–7.0 MPa, and more preferably 4.0–6.0 MPa; $H_2$/oil volume ratio: 200–1000, preferably 400–900, and more preferably 500–800; and liquid hourly space velocity: 0.2–5.0 $h^{-1}$, preferably 0.5–4.0 $h^{-1}$, and more preferably 0.8–3.0 $h^{-1}$.

The hydrorefining step, hydroupgrading step and hydrodewaxing step can be carried out respectively either on three beds in one reactor, or in two or three reactors combined in series.

The hydrorefining catalyst according to the present invention comprises preferably $\gamma$-$Al_2O_3$ or $\gamma$-$Al_2O_3$ containing a small amount of $SiO_2$ as carrier, and components of metals of Groups VIB and VIII in the Periodic Table of Elements, preferably W (and/or Mo) and Ni, as the active components. More preferably, the catalyst comprises $WO_3$ (and/or $MoO_3$) of 20–30 wt % and NiO of 8–12 wt % based on the weight of the catalyst. The catalyst has preferably a pore volume of 0.3–0.6 ml/g and a specific surface area of 200–650 $m^2$/g.

The hydroupgrading catalyst according to the present invention comprises preferably an ultra-stable Y-type molecular sieve and $\gamma$-$Al_2O_3$ or $\gamma$-$Al_2O_3$ containing a small amount of $SiO_2$ as carrier, and components of metals of Groups VIB and VIII in the Periodic Table of Elements, preferably W (and/or Mo) and Ni, as the active components. More preferably, the catalyst comprises $WO_3$ (and/or $MoO_3$) of 19–26 wt % and NiO of 6–11 wt % based on the weight of the catalyst, and an ultra-stable Y-type molecular sieve of an acidity (measured by the Pyridine Adsorption IR Method, hereinafter referred to as IR acidity, conducted by the acidimeter Necolet 555) of 0.6–1.4 mmol/g. The catalyst has preferably a pore volume of 0.20–0.50 ml/g and a specific surface area of 180–600 $m^2$/g.

The hydrodewaxing catalyst according to the present invention comprises a ZSM-type molecular sieve and $\gamma$-$Al_2O_3$, or $\gamma$-$Al_2O_3$ containing a small amount of $SiO_2$, as carrier, and metal (s) of Group VIII in the Periodic Table of Elements, preferably Ni and/or Co, as the active component. More preferably, the catalyst comprises NiO (and/or CoO) of 1.0–3.0 wt % based on the weight of the catalyst. The catalyst has preferably a pore volume of 0.15–0.40 ml/g and a specific surface area of 200–800 $m^2$/g. It is most desirable that the $NH_3$-TPD acid distribution of the hydrodewaxing catalyst should be as follows:

160° C.: 0.150–0.185 mmol/g;

250° C.: 0.115–0.145 mmol/g;

350° C.: 0.060–0.105 mmol/g;

450° C.: 0.045–0.065 mmol/g; and

530° C.: 0.005–0.020 mmol/g.

The catalyst components including the carrier components, for example, the ZSM-type molecular sieve, the Y-type molecular sieve, $\gamma$-$Al_2O_3$ and $\gamma$-$Al_2O_3$ containing a small amount of $SiO_2$, are known or can be prepared by known methods, and some of them are commercially available.

The hydrorefining catalyst according to the present invention can be prepared by spray-impregnating the pre-prepared alumina carrier with an aqueous solution containing the active metal components of the catalyst using a conventional method, then drying and calcining to obtain the catalyst product for the process according to the invention.

The hydroupgrading catalyst according to the present invention can be prepared by mixing an acidified alumina binder and an ultra-stable Y-type molecular sieve, kneading, rolling and pressing the blend into block mass, and extrusion molding the block mass by an extruder into carrier bars, and then drying, calcining and supporting active metals onto said carrier by a conventional method such as impregnation to obtain the catalyst product for the process according to the invention.

The hydrodewaxing catalyst according to the present invention can be prepared by mixing an acidified alumina as a binder with a ZSM-type molecular sieve, kneading, extruding and molding the resultant blend into bars, drying and calcining to obtain a carrier, which is then impregnated, dried, calcined, and passivated to obtain the catalyst product for the process according to the present invention.

Compared with the prior art, the advantages and features of the present invention are as follows:

1. The feedstocks are first hydrorefined under the selected conditions according to the present invention, with most of impurities such as sulfur, nitrogen and aromatics contained therein being removed, thus avoiding the poisoning effects of these impurities and aromatics on the catalysts used in the subsequent step(s), and improving the quality of the feedstock oils to be treated in the subsequent step(s), thereby relaxing the severity of the operation conditions in said step(s), which is beneficial to prolonging the service life of the catalysts.

2. Under the controlled reaction conditions, the hydrorefined and/or optionally hydroupgraded feedstock can enter directly into the subsequent step of the process, that is, the process of the present invention needs no further steps of heat exchanging and removing $NH_3$ and $H_2S$ formed in the reaction after the feedstock is hydrorefined and/or optionally hydroupgraded, thus the investment in apparatus for carrying out the process is reduced and the processing steps are simplified.

3. According to the present invention, the process can produce diesel oil products having significantly improved stability, which meet the new standards for diesel oil products.

4. By adjusting the reaction conditions within the controlled scopes, different fraction oils of inferior quality can be converted into various desired products to meet different needs.

5. In a preferred embodiment of the present invention, the hydrorefined feedstock enters into the hydroupgrading section to undergo the hydrodenitrogenation, hydrodesulfurization, hydro-saturation of aromatics and selective ring-opening reactions, whereby effectively boosting the cetane number of the product, and further improving the quality of the reactant effluent to be fed into the hydrodewaxing section and thus further relaxing the severity of the operation conditions therein. And when the preferred hydroupgrading catalyst is used, better results are achieved.

6. In a preferred embodiment of the present invention, the hydrorefining catalyst to be used has a higher content of Ni (preferably 8–12 wt % of NiO based on the total weight of the catalyst), so it is liable to form a partial Ni—Al spinel in the catalyst and to adsorb hydrogen at a high temperature, thus enhancing the catalyst's anti-coking ability. The catalyst can well maintain its good activity even at a higher temperature, and therefore the reaction temperatures in the hydrorefining section and in the subsequent section(s) can match better with each other when such a hydrorefining catalyst is used.

7. In a preferred embodiment of the present invention, the hydrodewaxing catalyst to be used has a unique acidic property and more excellent resistance to ammonia and acids, thus before the feedstock is fed into the bed for hydrodewaxing, $NH_3$ and $H_2S$ need not to be removed from the feedstocks. In addition, this ensuring that the temperature in the hydrodewaxing section can match better with that in the upper section without any further heat exchanging steps, and better results are achieved.

EXAMPLES

The present invention is further illustrated in detail with reference to the following examples which are provided for purposes of illustration and shall not be construed as limiting the present invention.

Feedstock: a wax-containing fraction oil was used as the feedstock in the examples and comparative examples. The properties of the feedstock are shown in Table 1 (in which GB stands for Chinese National Standard and ZBE for Chinese Ministerial Standard).

TABLE 1

The properties of the feedstock

| Analysis Items | Feedstock Oil | Analysis Method |
|---|---|---|
| Density (at 20° C., kg/m$^3$) | 869.4 | GB2540-81 |
| Distillation Range (° C.) | 179–365 | GB255-77 |
| Viscosity (at 20° C., mm$^2$/s) | 4.013 | GB255-83 |
| Sulfur Content (μg/g) | 4338 | GB/T 8025-87 |
| Nitrogen Content (μg/g) | 1168 | GB/T 8024-87 |
| Basic Nitrogen (μg/g) | 725 | ZBE 3000-92 |
| Cetane Number | 43 | GB 386 |
| Solidifying Point (° C.) | −1 | GB 510-77 |

Catalysts: The hydrorefining catalyst was prepared as follows: a pre-prepared alumina carrier which has a pore volume of 0.65 ml/g and a specific surface area of 320 m$^2$/g was spray-impregnated with an aqueous solution containing a given amount of active metal components of the catalyst, then dried at 100–120° C. and calcined at 450–550° C. to obtain the hydrorefining catalyst (No. HT-1, -2, -3 or -4). The specific conditions for preparing the catalysts are shown in Table 2, and the composition and properties of the catalyst are shown in Table 3.

The hydroupgrading catalyst was prepared as follows: a given amount of an acidified alumina binder and a given amount of an ultra-stable Y type molecular sieve having a crystal cell size of 24.38A$^0$, a relative crystallinity of 95% and a ratio of silica to alumina of 14 were mixed, kneaded, rolled and pressed into block mass, which was extrusion moulded by an extruder into carrier bars, then the carrier was dried at 100–120° C. and calcined at 600–700 °C. and then impregnated with an aqueous solution containing a given amount of active metal component, then dried at 100–120° C. and calcined at 450–550° C. to obtain the catalyst (No. HC-1, -2, -3, or -4). The specific conditions for preparing the catalysts are shown in Table 2, and the composition and properties of the catalyst are shown in Table 3.

The hydrodewaxing catalyst was prepared as follows: an acidified alumina as a binder was mixed with a ZSM type molecular sieve having a ratio of silica to alumina of 40, a relative crystallinity of 83% and a $NaO_2$ content of 3.50, then, the mixture was kneaded, extruded and molded into bars, which was dried at 100–130° C. and calcined at 450–580° C. to obtain a carrier, which is then impregnated with an aqueous solution containing a given amount of active metal component, then dried at 220–280° C. and calcined at 450–580° C., and passivated with vapor steam at 500–600° C. to obtain the catalyst (No. HDW-1, -2, -3, or -4). The specific conditions for preparing the catalysts are shown in Table 2, and composition and properties of the catalyst are shown in Table 3.

TABLE 2

The specific conditions for preparing the catalysts

| The hydrorefining catalyst No. | HT-1 | HT-2 | HT-3 | HT-4 |
|---|---|---|---|---|
| Drying temperature of carrier (° C.) | 100 | 115 | 120 | 105 |
| Drying period of carrier (hrs) | 10 | 8 | 14 | 16 |
| Calcining temperature of carrier (° C.) | 600 | 630 | 635 | 650 |
| Calcining period of carrier (hrs) | 4 | 6 | 5 | 6 |
| Impregnating period (hrs) | 2 | 4 | 3 | 4 |
| Drying temperature of catalyst (° C.) | 100 | 115 | 120 | 105 |
| Drying period of catalyst (hrs) | 10 | 8 | 14 | 16 |
| Calcining temperature of catalyst (° C.) | 450 | 480 | 520 | 550 |
| Calcining period of catalyst (hrs) | 4 | 6 | 5 | 6 |
| **The hydroupgrading catalyst No.** | **HC-1** | **HC-2** | **HC-3** | **HC-4** |
| Kneading period (mins) | 40 | 35 | 42 | 38 |
| Rolling period (mins) | 20 | 35 | 40 | 35 |
| Drying temperature of carrier (° C.) | 100 | 120 | 115 | 110 |
| Drying period of carrier (hrs) | 10 | 12 | 14 | 16 |
| Calcining temperature of carrier (° C.) | 600 | 650 | 620 | 700 |
| Calcining period of carrier (hrs) | 4 | 6 | 5 | 6 |
| Impregnating period (hrs) | 6 | 4 | 7 | 8 |
| Drying temperature of catalyst (° C.) | 100 | 120 | 115 | 110 |
| Drying period of catalyst (hrs) | 10 | 12 | 14 | 16 |
| Calcining temperature of catalyst (° C.) | 450 | 480 | 500 | 550 |
| Calcining period of catalyst (hrs) | 4 | 6 | 5 | 6 |
| **The hydrodewaxing catalyst No.** | **HDW-1** | **HDW-2** | **HDW-3** | **HDW-4** |
| Kneading period (mins) | 20 | 40 | 35 | 30 |
| Rolling period (mins) | 35 | 40 | 30 | 45 |
| Drying temperature of carrier (° C.) | 120 | 115 | 110 | 125 |
| Drying period of carrier (hrs) | 14 | 16 | 15 | 18 |
| Calcining temperature of carrier (° C.) | 650 | 630 | 640 | 600 |
| Calcining period of carrier (hrs) | 4 | 5 | 5 | 6 |
| Impregnating period (hrs) | 4 | 6 | 6 | 5 |
| Drying temperature of catalyst (° C.) | 245 | 230 | 260 | 240 |
| Drying period of catalyst (hrs) | 14 | 16 | 13 | 15 |
| Calcining temperature of catalyst (° C.) | 480 | 500 | 560 | 540 |
| Calcining period of catalyst (hrs) | 5 | 6 | 4 | 7 |
| Vapor treating pressure (Mpa) | 0.20 | 0.25 | 0.22 | 0.25 |
| Vapor treating period (hrs) | 10 | 9 | 12 | 14 |
| Vapor treating temperature (° C.) | 550 | 580 | 540 | 530 |

TABLE 3

The compositions and properties of the tested Hydrorefining catalysts.

| Catalyst Type | Hydrorefining catalyst | | | | Analysis Method |
|---|---|---|---|---|---|
| Catalyst No. | HT-1 | HT-2 | HT-3 | HT-4 | |
| Catalyst Compositions (wt %) | | | | | |
| NiO | 8 | 10 | 11 | 4 | Photoelectric colorimeter |
| $WO_3$ | 28 | 26 | 22 | 18 | Photoelectric colorimeter |
| $Al_2O_3$ | balance | balance | balance | balance | |
| Pore Volume (ml/g) | 0.34 | 0.36 | 0.37 | 0.35 | $N_2$ low temperature adsorption |
| Specific Surface Area ($m^2$/g) | 242 | 250 | 253 | 249 | $N_2$ low temperature adsorption |
| Bulk Density (g/ml) | 1.02 | 1.02 | 1.03 | 1.01 | Measuring cylinder |
| Shape | clover | clover | clover | clover | Visual observation |
| Average Particle Size (mm) | ϕ 1.3 × (3–5) | ϕ 1.3 × (3–5) | ϕ 1.3 × (3–5) | ϕ 1.3 × (3–5) | Caliber rule |

The compositions and properties of the tested hydroupgrading catalysts

| Catalyst Type | Hydroupgrading catalyst | | | | Analysis method |
|---|---|---|---|---|---|
| Catalyst No. | HC-1 | HC-2 | HC-3 | HC-4 | |
| Catalyst Compositions (wt %) | | | | | |
| NiO | 7 | 9 | 10 | 4 | Photoelectric colorimeter |
| $WO_3$ | 25 | 23 | 20 | 21 | Photoelectric colorimeter |
| Ultra-stable Y type Molecular Sieve | 15 | 14 | 15 | 16 | |
| $Al_2O_3$ | balance | balance | balance | balance | |
| Pore Volume (ml/g) | 0.28 | 0.30 | 0.35 | 0.35 | $N_2$ low temperature adsorption |
| Specific Surface Area ($m^2$/g) | 254 | 289 | 276 | 280 | $N_2$ low temperature adsorption |
| Bulk Density (g/ml) | 0.90 | 0.92 | 0.98 | 0.95 | Measuring cylinder |
| Shape | clover | clover | clover | clover | Visual observation |
| Average Particle Size (mm) | ϕ 1.3 × (3–5) | ϕ 1.3 × (3–5) | ϕ 1.3 × (3–5) | ϕ 1.3 × (3–5) | Caliber rule |
| IR Acidity of Molecular Sieve (mM/g) | 0.8 | 1.1 | 1.3 | 2.5 | TPD method |

The compositions and properties of the tested hydrodewaxing catalysts

| Catalyst Type | Hydrodewaxing Catalyst | | | | Analysis method |
|---|---|---|---|---|---|
| Catalyst No. | HDW-1 | HDW-2 | HDW-3 | HDW-4 | |
| Catalyst Compositions (wt %) | | | | | |
| NiO | 1.6 | 1.8 | 2.2 | 1.9 | Photoelectric colorimeter |
| $WO_3$ | | | | | Photoelectric colorimeter |
| $Al_2O_3$ | balance | balance | balance | balance | |
| ZSM-5 Molecular Sieve | 75 | 80 | 78 | 76 | |
| Pore Volume (ml/g) | 0.20 | 0.29 | 0.20 | 0.20 | $N_2$ low temperature adsorption |
| Specific Surface Area ($m^2$/g) | 289 | 302 | 289 | 289 | $N_2$ low temperature adsorption |
| Bulk Density (g/ml) | 0.74 | 0.76 | 0.74 | 0.74 | Measuring cylinder |
| Shape | clover | clover | clover | clover | Visual observation |
| Average Particle Size (mm) | ϕ 1.3 × (3–5) | ϕ 1.3 × (3–5) | ϕ 1.3 × (3–5) | ϕ 1.3 × (3–5) | Caliber rule |
| TPD Acid Distribution (mmol/g) | | | | | TPD method |
| 160° C. | 0.158 | 0.183 | 0.179 | 0.565 | |
| 250° C. | 0.110 | 0.135 | 0.126 | 0.440 | |
| 350° C. | 0.075 | 0.100 | 0.092 | 0.326 | |
| 450° C. | 0.050 | 0.062 | 0.058 | 0.246 | |
| 530° C. | 0.008 | 0.016 | 0.012 | 0.155 | |

Examples 1 to 14 illustrate the process of the present invention comprising the hydrorefining step and hydrodewaxing step combined in series. The single-stage technological processes combined in series of the first technical solution was carried out as follows: a wax-containing fraction oil as shown in Table 1 was heated to a given temperature and mixed with hydrogen, then the mixture was at first fed into a first reactor, in which the feed mixture underwent mainly hydrodesulfurization, hydrodenitrogenation, hydrosaturation of aromatics and the like over the hydrorefining catalyst under controlled and appropriate reaction conditions. The effluent from the first reactor was then introduced completely into a second reactor in which the stream underwent shape cracking over the catalytic dewaxing catalyst under controlled and appropriate reaction conditions to obtain the diesel oils of superior quality and low solidifying point. The catalysts used in Examples 1 to 8 are the preferred ones and have indexes within the preferred ranges, and the catalysts used in Examples 9 to 14 are the ordinary ones and have indexes within the general ranges. The process conditions are shown in Table 4, and the results are shown in Table 5.

Comparative Examples 1 to 2 illustrate the production of diesel oils using a single technological process of hydrodewaxing. The process conditions are shown in Table 4, and the results are shown in Table 5.

TABLE 4

Process conditions for the tests.

| Example Nos. | 1 | 2 | 3 | 4 | 5 | 6 | 7 | 8 | 9 |
|---|---|---|---|---|---|---|---|---|---|
| | The First Reactor (Hydrorefining) | | | | | | | | |
| $H_2$ Partial Pressure (MPa) | 4.0 | 6.0 | 5.0 | 8.0 | 4.0 | 6.0 | 7.0 | 6.0 | 4.0 |
| $H_2$/Oil Volume Ratio | 400 | 400 | 800 | 500 | 500 | 500 | 600 | 500 | 400 |
| LHSV ($h^{-1}$) | 1.5 | 2.0 | 1.5 | 2.0 | 1.0 | 2.0 | 1.0 | 3.0 | 1.5 |
| Reaction Temperature(° C.) | 370 | 375 | 372 | 370 | 360 | 372 | 355 | 390 | 370 |
| Catalyst Nos. | HT-1 | HT-1 | HT-2 | HT-2 | HT-3 | HT-3 | HT-3 | HT-3 | HT-4 |
| | The Second Reactor (Hydrodewaxing) | | | | | | | | |
| $H_2$ Partial Pressure (Mpa) | 4.0 | 6.0 | 5.0 | 8.0 | 4.0 | 6.0 | 7.0 | 6.0 | 4.0 |
| $H_2$/Oil Volume Ratio | 400 | 400 | 800 | 500 | 500 | 500 | 600 | 500 | 400 |
| LHSV ($h^{-1}$) | 1.5 | 2.0 | 1.5 | 2.0 | 1.0 | 2.0 | 1.0 | 3.0 | 1.5 |
| Reaction Temperature (° C.) | 380 | 385 | 382 | 380 | 370 | 385 | 365 | 400 | 385 |
| Catalyst Nos. | HDW-1 | HDW-1 | HDW-2 | HDW-2 | HDW-3 | HDW-3 | HDW-3 | HDW-3 | HDW-4 |
| Deactivation Rate (° C./d) | 0.005 | 0.006 | 0.004 | 0.014 | 0.004 | 0.006 | 0.004 | 0.019 | 0.055 |

| Example Nos. | 10 | 11 | 12 | 13 | 14 | Comp. Ex. No. 1 | Comp. Ex. No. 2 |
|---|---|---|---|---|---|---|---|
| | The First Reactor (Hydrorefining) | | | | | | |
| $H_2$ Partial Pressure (MPa) | 6.0 | 5.0 | 8.0 | 7.0 | 6.0 | | |
| $H_2$/Oil Volume Ratio | 400 | 800 | 500 | 600 | 500 | | |
| LHSV ($h^{-1}$) | 2.0 | 1.5 | 2.0 | 1.0 | 3.0 | | |
| Reaction Temperature(° C.) | 375 | 372 | 375 | 355 | 390 | | |
| Catalyst Nos. | HT-4 | HT-4 | HT-4 | HT-4 | HT-4 | | |
| | The Second Reactor (Hydrodewaxing) | | | | | | |
| $H_2$ Partial Pressure (MPa) | 6.0 | 5.0 | 8.0 | 7.0 | 6.0 | 4.0 | 6.0 |
| $H_2$/Oil Volume Ratio | 400 | 800 | 500 | 600 | 500 | 400 | 400 |
| LHSV ($h^{-1}$) | 2.0 | 1.5 | 2.0 | 1.0 | 3.0 | 1.5 | 2.0 |
| Reaction Temperature (° C.) | 390 | 387 | 390 | 370 | 405 | 390 | 395 |
| Catalyst Nos. | HDW-4 | HDW-4 | HDW-4 | HDW-4 | HDW-4 | HDW-1 | HDW-1 |
| Deactivation Rate (° C./d) | 0.050 | 0.058 | 0.060 | 0.045 | 0.087 | 0.45 | 0.49 |

TABLE 5

The main properties of the products

| Examples | Examples | | | | | | | | |
|---|---|---|---|---|---|---|---|---|---|
| Example Nos. | 1 | 2 | 3 | 4 | 5 | 6 | 7 | 8 | 9 |
| Density (at 20° C., kg/$m^3$) | 855.6 | 857.2 | 855.0 | 856.0 | 855.9 | 859.0 | 856.6 | 856.0 | 855.3 |
| Yield (m %) | 86.8 | 87.5 | 87.6 | 87.9 | 87.6 | 87.7 | 87.8 | 87.9 | 86.5 |
| Distillation Range (° C.) | 180–359 | 184–360 | 188–366 | 183–365 | 180–367 | 185–361 | 182–364 | 180–366 | 179–356 |
| Viscosity (20° C., $mm^2$/s) | 3.904 | 3.892 | 3.882 | 3.809 | 3.800 | 3.806 | 3.809 | 3.799 | 3.893 |
| Sulfur Content (μg/g) | 165 | 131 | 155 | 103 | 140 | 133 | 128 | 127 | 230 |
| Nitrogen Content (μg/g) | 135 | 117 | 128 | 95 | 102 | 96 | 97 | 95 | 152 |
| Basic Nitrogen Content (μg/g) | 80 | 72 | 76 | 52 | 50 | 53 | 50 | 48 | 102 |
| Residues (Acetic Acid Method, m %) | 0.13 | 0.10 | 0.12 | 0.12 | 0.13 | 0.12 | 0.12 | 0.10 | 0.20 |
| Solidifying Point(° C.) | −40 | −37 | −35 | −36 | −40 | −38 | −40 | −40 | −39 |
| Cold Filtering Point(° C.) | <−30 | <−30 | <−30 | <−30 | <−30 | <−30 | <−30 | <−30 | <−30 |

| Example Nos. | 10 | 11 | 12 | 13 | 14 | Comp. Ex. No. 1 | Comp. Ex. No. 2 |
|---|---|---|---|---|---|---|---|
| Density (20° C., kg/$m^3$) | 857.0 | 858.6 | 856.7 | 856.8 | 855.9 | 855.8 | 856.9 |
| Yield (wt %) | 86.9 | 87.4 | 87.5 | 86.7 | 87.9 | 86.7 | 87.8 |
| Distillation Range (° C.) | 183–358 | 181–365 | 180–368 | 180–363 | 181–365 | 183–362 | 180–365 |
| Viscosity (20° C., $mm^2$/s) | 3.992 | 3.810 | 3.889 | 3.876 | 3.889 | 3.997 | 3.961 |
| Sulfur Content (μg/g) | 288 | 297 | 220 | 253 | 298 | 4408 | 4381 |
| Nitrogen Content (μg/g) | 171 | 180 | 112 | 166 | 197 | 1204 | 1196 |
| Basic Nitrogen Content (μg/g) | 97 | 99 | 87 | 87 | 95 | 762 | 775 |
| Residues (Acetic Acid Method, wt %) | 0.20 | 0.19 | 0.18 | 0.19 | 0.20 | 0.38 | 0.35 |
| Solidifying Point (° C.) | −35 | −38 | −35 | −35 | −40 | −38 | −35 |
| Cold Filtering Point (° C.) | <−30 | <−30 | <−30 | <−30 | <−30 | <−30 | <−30 |

In Table 6 (see Table 6: Index of standards for diesel oils), the residue measured by acetic acid method is an index to evaluate the storage stability of diesel oil products, and the value of >0.20% indicates that the storage stability of the diesel oils is good. From the data of Table 5, it can be seen that the diesel oil products obtained from Examples 1–14 are all those of low solidifying point and superior quality, which all meet the new standards for diesel oils (see Table 6), while the diesel oil products obtained from the Comparative Examples 1 and 2 are inferior in storage stability and their sulfur content does not meet the new standards for diesel oil products, thus demonstrating the superiority of the present invention.

From the data showing the deactivation rates of the hydrodewaxing catalysts listed in Table 4, it can be seen that the deactivation rates of the catalysts used in Examples 1 and 2 are obviously slower than those in the Comparative Examples 1 and 2, thus demonstrating the superiority of the present invention; and that the deactivation rates of the catalysts used in Examples 1 to 8 are obviously slower than those in the Examples 9 to 14, thus demonstrating the prominent effects of the preferred embodiment of the present invention.

TABLE 6

Index of standards for diesel oils.

| Items | Light diesel oil No.-20 | Light diesel oil No.-35 | Wide range of diesel oil No.-20 |
|---|---|---|---|
| Distillation Range (° C.) | | | |
| 10% | | | ≥270 |
| 50% | ≥300 | ≥300 | ≥315 |
| 90% | ≥355 | ≥355 | ≥360(88%) |
| Viscosity (at 20° C., $mm^2/s$) | 2.5–8.0 | 2.5–8.0 | 3.0–10.0 |
| Acidity (mgKOH/100 ml) | ≥7.0 | ≥7.0 | |
| Residual Carbon in 10% Distilled material (wt %) | | | ≥0.3 |
| Sulfur Content (μg/g) | ≥500 | ≥500 | ≥500 |
| Residues (Acetic Acid Method, wt %) | ≥0.2 | ≥0.2 | ≥0.2 |
| Cetane Number | ≤45 | ≤45 | ≤45 |
| Solidifying point (° C.) | ≥−20 | ≥−35 | ≥−20 |
| Cold Filtering Point (° C.) | ≥−14 | ≥−29 | ≥−14 |

Examples 15 to 22 illustrate the process of the present invention comprising the hydrorefining step, hydroupgrading step and hydrodewaxing step combined in series. The single-stage technological process was carried out as follows: a wax-containing fraction oil as shown in Table 1 was heated to a given temperature and mixed with hydrogen, then the mixture was fed into a first reactor bed, in which the feed mixture underwent mainly hydrodesulfurization, hydrodenitrogenation, hydrosaturation of aromatics and the like over a hydrorefining catalyst under controlled and appropriate reaction conditions. The effluent from the first reactor was then directly introduced completely into a second reactor bed in which the stream underwent desulfurization, denitrogenation, saturation of aromatics and ring-opening reaction over a hydroupgrading catalyst under substantially the same reaction conditions as in the hydrorefining section. The effluent from the second reactor was then directly introduced into a third reactor bed in which the stream underwent shape cracking over a catalytic dewaxing catalyst under controlled and appropriate reaction conditions to obtain the diesel oil products of superior quality and low solidifying point, which have a lower sulfur content and a higher cetane number. The catalysts used in Examples 15 to 20 are the preferred ones and have indexes within the preferred ranges, and the catalysts used in Examples 21 to 22 are the ordinary ones and have indexes within the general ranges. The process conditions are shown in Table 7, and the results are shown in Table 8.

Comparative examples 3 to 6 illustrate the production of diesel oils using a single-stage process comprising a hydrorefining step, a hydrodewaxing step and a hydroupgrading step combined in series, the sequence of which is different from that of the present invention. The catalysts used therein are the same as the preferred ones of the present invention. The process conditions and the reaction sequence are shown in Table 7, and the results are shown in Table 8.

TABLE 7

Process conditions for the tests.

| Example Nos. | 15 | 16 | 17 | 18 | 19 | 20 | 21 | 22 |
|---|---|---|---|---|---|---|---|---|
| The First Reactor (Hydrorefining) | | | | | | | | |
| $H_2$ Partial Pressure (MPa) | 3.5 | 5.0 | 7.0 | 7.0 | 5.0 | 3.5 | 5.0 | 7.0 |
| $H_2$/Oil Volume Ratio | 400 | 600 | 800 | 600 | 600 | 400 | 600 | 800 |
| LHSV ($h^{-1}$) | 1.0 | 2.0 | 3.0 | 3.5 | 3.0 | 2.0 | 2.0 | 3.0 |
| Reaction Temperature (° C.) | 370 | 375 | 380 | 385 | 383 | 378 | 375 | 380 |
| Catalyst Nos. | HT-1 | HT-1 | HT-2 | HT-2 | HT-3 | HT-3 | HT-4 | HT-4 |
| The Second Reactor (Hydroupgrading) | | | | | | | | |
| $H_2$ Partial Pressure (MPa) | 3.5 | 5.0 | 7.0 | 7.0 | 5.0 | 3.5 | 5.0 | 7.0 |
| $H_2$/Oil Volume Ratio | 400 | 600 | 800 | 600 | 600 | 400 | 600 | 800 |
| LHSV ($h^{-1}$) | 1.5 | 2.5 | 4.0 | 4.5 | 4.0 | 2.5 | 2.5 | 4.0 |
| Reaction Temperature (° C.) | 370 | 375 | 380 | 385 | 383 | 378 | 375 | 380 |
| Catalyst Nos. | HC-1 | HC-1 | HC-2 | HC-2 | HC-3 | HC-3 | HC-4 | HC-4 |
| Deactivation Rate (° C./d) | 0.006 | 0.003 | 0.001 | 0.003 | 0.005 | 0.006 | 0.030 | 0.010 |

TABLE 7-continued

Process conditions for the tests.

| The Third Reactor (Hydrodewaxing) | | | | | | | | |
|---|---|---|---|---|---|---|---|---|
| $H_2$ Partial Pressure (Mpa) | 3.5 | 5.0 | 7.0 | 7.0 | 5.0 | 3.5 | 5.0 | 7.0 |
| $H_2$/Oil Volume Ratio | 400 | 600 | 800 | 800 | 600 | 400 | 600 | 800 |
| LHSV ($h^{-1}$) | 1.0 | 2.0 | 3.0 | 3.5 | 3.0 | 2.0 | 2.0 | 3.0 |
| Reaction Temperature (° C.) | 370 | 375 | 380 | 385 | 383 | 378 | 375 | 380 |
| Catalyst Nos. | HDW-1 | HDW-1 | HDW-2 | HDW-2 | HDW-3 | HDW-3 | HDW-4 | HDW-4 |
| Deactivation Rate (° C./d) | 0.006 | 0.003 | 0.001 | 0.003 | 0.005 | 0.006 | 0.030 | 0.010 |

| Example Nos. | Comp. Ex. 3 | Comp. Ex. 4 | Comp. Ex. 5 | Comp. Ex. 6 |
|---|---|---|---|---|
| **The First Reactor (Hydrorefining)** | | | | |
| $H_2$ Partial Pressure (MPa) | 3.5 | 5.0 | 7.0 | 5.0 |
| $H_2$/Oil Volume Ratio | 400 | 600 | 800 | 600 |
| LHSV ($h^{-1}$) | 1.0 | 2.0 | 3.0 | 3.0 |
| Reaction Temperature (° C.) | 370 | 375 | 380 | 383 |
| Catalyst Nos. | HT-1 | HT-1 | HT-2 | HT-3 |
| **The Second Reactor (Hydrodewaxing)** | | | | |
| $H_2$ Partial Pressure (MPa) | 3.5 | 5.0 | 7.0 | 5.0 |
| $H_2$/Oil Volume Ratio | 400 | 600 | 800 | 600 |
| LHSV ($h^{-1}$) | 1.0 | 2.0 | 3.0 | 3.0 |
| Reaction Temperature (° C.) | 370 | 375 | 380 | 383 |
| Catalyst Nos. | HDW-1 | HDW-1 | HDW-2 | HDW-3 |
| Deactivation Rate (° C./d) | 0.006 | 0.004 | 0.002 | 0.006 |
| **The Third Reactor (Hydroupgrading)** | | | | |
| $H_2$ Partial Pressure (Mpa) | 3.5 | 5.0 | 7.0 | 5.0 |
| $H_2$/Oil Volume Ratio | 400 | 600 | 800 | 600 |
| LHSV ($h^{-1}$) | 1.5 | 2.5 | 4.0 | 4.0 |
| Reaction Temperature (° C.) | 370 | 375 | 380 | 383 |
| Catalyst Nos. | HC-1 | HC-1 | HC-2 | HC-3 |
| Deactivation Rate (° C./d) | 0.006 | 0.004 | 0.002 | 0.006 |

TABLE 8

The main properties of the products

| Product from | Ex. 15 | Ex. 16 | Ex. 17 | Ex. 18 | Ex. 19 | Ex. 20 | Ex. 21 | Ex. 22 | Comp. Ex. 3 | Comp. Ex. 4 | Comp. Ex. 5 | Comp. Ex. 6 |
|---|---|---|---|---|---|---|---|---|---|---|---|---|
| Density (20° C., kg/$m^3$) | 879.0 | 879.5 | 879.2 | 879.6 | 879.8 | 879.1 | 879.6 | 879.5 | 879.1 | 879.6 | 879.1 | 879.8 |
| Yield (wt %) | 82.5 | 83.0 | 82.8 | 83.1 | 83.2 | 82.8 | 82.7 | 83.0 | 82.8 | 83.2 | 82.9 | 83.0 |
| Distillation Range (° C.) | | | | | | | | | | | | |
| 50% | 260 | 262 | 261 | 259 | 265 | 262 | 263 | 260 | 263 | 261 | 262 | 262 |
| 90% | 330 | 333 | 335 | 340 | 337 | 332 | 347 | 339 | 332 | 330 | 333 | 338 |
| 95% | 348 | 350 | 353 | 352 | 352 | 350 | 352 | 354 | 350 | 355 | 352 | 354 |
| Viscosity (20° C. $mm^2$/s) | 5.940 | 5.988 | 5.993 | 6.001 | 5.900 | 6.008 | 6.002 | 6.013 | 5.945 | 5.986 | 5.990 | 6.008 |
| Sulfur Content ($\mu$g/g) | 53.0 | 45.2 | 50.5 | 53.4 | 48.0 | 60.3 | 58.0 | 58.9 | 59.8 | 48.1 | 51.1 | 62.3 |
| Nitrogen Content ($\mu$g/g) | 48.0 | 36.3 | 42.0 | 46.9 | 38.2 | 52.7 | 42.0 | 50.0 | 49.2 | 38.4 | 48.0 | 50.0 |
| Cetane Number | 46.0 | 46.3 | 46.1 | 45.5 | 46.8 | 46.2 | 45.0 | 45.5 | 44.0 | 44.7 | 44.2 | 44.4 |
| Solidifying Point (° C.) | −45 | −38 | −36 | −36 | −36 | −39 | −36 | −35 | −40 | −36 | −35 | −36 |
| Cold Filtering Point (° C.) | −32 | −30 | −30 | −29 | −29 | −30 | −29 | −29 | −30 | −29 | −30 | −29 |
| Iodine Value (gI/100 mg) | 1.40 | 1.80 | 2.08 | 2.14 | 2.00 | 1.58 | 2.05 | 2.80 | 1.53 | 1.92 | 2.00 | 2.14 |
| Oxidation Stability | | | | | | | | | | | | |
| Total Insolubles (mg/100 ml) | 1.9 | 1.8 | 2.0 | 2.1 | 2.0 | 2.1 | 2.4 | 2.2 | 1.8 | 1.8 | 2.0 | 2.1 |

In Table 8, the oxidation stability (the total insoluble residues) is an indication to evaluate the storage stability of diesel oil products, and the value of the total insoluble residues >2.5 mg/100 ml and the iodine value >6g/100 mg indicate that the storage stability of the diesel oils is good. From the data in Table 8, it can be seen that the diesel oil products obtained from Examples 15–22 all have low solidifying point and superior quality, and have a sulfur content of less than 500 $\mu$g/g, and have a cetane number of more than 45. The diesel oil products obtained from Examples 15–22 all meet the new standards for diesel oils.

The reaction conditions used in Comparative Examples 3 to 6 are the same respectively as those used in Examples 15, 16, 17 and 19. From Table 8 it can be seen that the cetane number of the products from the Comparative Examples are obviously less than that from the Examples, demonstrating the superiority of the present invention.

From the data showing the deactivation rates of the catalysts listed in table 7, it can be seen that under the conditions that the obtained diesel oil products would meet the new standards for diesel oils, the deactivation rates of the catalysts used in Examples 21 and 22 are obviously faster than those in the Examples 16 and 17 in which the other conditions are the same as those in Examples 21 and 22 respectively, thus demonstrating the superiority of the preferred technical solution of the present invention.

What is claimed is:

1. A process for producing diesel oils of superior quality and low solidifying point from inferior quality fraction oils, comprising the following steps combined in series:

(1) hydrorefining the feedstock over a hydrorefining catalyst in the presence of hydrogen under the following conditions:
reaction temperature: 300–420° C.;
hydrogen partial pressure: 2.0–8.0Mpa
$H_2$/oil volume ratio: 200–1000; and
liquid hourly space velocity: 0.5–5.0 $h^{-1}$;

(2) hydroupgrading the effluent from step (1) over a hydroupgrading catalyst in the presence of hydrogen under the following conditions:
reaction temperature: 320–430° C.;
hydrogen partial pressure: 2.0–8.0Mpa
$H_2$/oil volume ratio: 200–1000; and
liquid hourly space velocity: 0.5–5.0 $h^{-1}$; and (3) hydrodewaxing the effluent from step (2) over a hydrodewaxing catalyst in the presence of hydrogen under the following conditions:
reaction temperature: 300–430° C.;
hydrogen partial pressure: 2.0–8.0Mpa
$H_2$/oil volume ratio: 200–1000; and
liquid hourly space velocity: 0.2–5.0 $h^{-1}$, and wherein the final diesel oils have a cetane number of not less than 45.

2. The process for producing diesel oils according to claim 1, wherein said hydrorefining step is carried out at a temperature of 320–400° C. under a hydrogen partial pressure of 3.0–7.0 Mpa, and with a $H_2$/oil volume ratio of 400–900 and a liquid hourly space velocity of 0.8–4.0 $h^{-1}$.

3. The process for producing diesel oils according to claim 1, wherein said hydrorefining step is carried out at a temperature of 340–410° C. under a hydrogen partial pressure of 3.0–7.0 Mpa, and with a $H_2$/oil volume ratio of 400–900 and a liquid hourly space velocity of 0.8–4.0 $h^{-1}$.

4. The process for producing diesel oils according to claim 1, wherein said hydrorefining step is carried out at a temperature of 320–410° C. under a hydrogen partial pressure of 3.0–7.0 Mpa, and with a $H_2$/oil volume ratio of 400–900 and a liquid hourly space velocity of 0.5–4.0 $h^{-1}$.

5. The process for producing diesel oils according to claim 1, wherein said hydrorefining step is carried out at a temperature of 340–380° C. under a hydrogen partial pressure of 4.0–6.0 Mpa, and with a $H_2$/oil volume ratio of 500–800 and a liquid hourly space velocity of 1.0–3.0 $h^{-1}$.

6. The process for producing diesel oils according to claim 1, wherein said hydrorefining step is carried out at a temperature of 350–390° C. under a hydrogen partial pressure of 4.0–6.0 Mpa, and with a $H_2$/oil volume ratio of 500–800 and a liquid hourly space velocity of 1.0–3.0 $h^{-1}$.

7. The process for producing diesel oils according to claim 1, wherein said hydrodewaxing step is carried out at a temperature of 340–390° C. under a hydrogen partial pressure of 4.0–6.0 Mpa, and with a $H_2$/oil volume ratio of 500–800 and a liquid hourly space velocity of 0.8–3.0 $h^{-1}$.

8. The process for producing diesel oils according to claim 1, wherein said hydrorefining catalyst comprises a metal selected from Group VIB and VIII metals -of the Periodic Table of Elements as a hydrogenation component, and $\gamma$-$Al_2O_3$ or $\gamma$-$Al_2O_3$ containing $SiO_2$ as a carrier.

9. The process for producing diesel oils according to claim 8, wherein said hydrorefining catalyst comprises tungsten and/or molybdenum and nickel.

10. The process for producing diesel oils according to claim 9, wherein said hydrorefining catalyst comprises $WO_3$ and/or $MoO_3$ in an amount of 20–30 wt % and NiO in an amount of 8–12 wt.% based on the total weight of the catalyst.

11. The process for producing diesel oils according to claim 1, wherein said hydrorefining catalyst has a pore volume of 0.3–0.6 ml/g and a specific surface area of 200–650 $m^2$/g.

12. The process for producing diesel oils according to claim 1, wherein said hydroupgrading catalyst comprises a metal selected from Group VIB and VIII metals of the Periodic Table of Elements as a hydrogenation component, and an ultra-stable Y molecular sieve and $\gamma$-$Al_2O_3$ or $\gamma$-$Al_2O_3$ containing $SiO_2$ as a carrier.

13. The process for producing diesel oils according to claim 12, wherein said hydroupgrading catalyst comprises tungsten and/or molybdenum and nickel as hydrogenation metals.

14. The process for producing diesel oils according to claim 13, wherein said hydroupgrading catalyst comprises $WO_3$ and/or $MoO_3$ of 19–26 wt % and NiO of 6–11 wt % based on the total weight of the catalyst.

15. The process for producing diesel oils according to claim 12, wherein said ultra-stable Y molecular sieve has an IR acidity of 0.6–1.4 mmol/g.

16. The process for producing diesel oils according to claim 1, wherein said hydroupgrading catalyst has a pore volume of 0.20–0.50 ml/g and a specific surface area of 180–600 $m^2$/g.

17. The process for producing diesel oils according to claim 1, wherein said hydrodewaxing catalyst comprises a component, of metal(s) selected from Group VIII metals in the Periodic Table of Elements as active component, and a mixture of ZSM-5 molecular sieve and $\gamma$-$Al_2O_3$ or $\gamma$-$Al_2O_3$ containing $SiO_2$ as carrier.

18. The process for producing diesel oils according to claim 17, wherein said hydrodewaxing catalyst comprises nickel and/or cobalt as the active metal.

19. The process for producing diesel oils according to claim 18, wherein said hydrodewaxing catalyst comprises NiO and/or CoO in an amount of 1.0–3.0 wt % based on the total weight of the catalyst.

20. The process for producing diesel oils according to claim 1, wherein said hydrodewaxing catalyst has a pore volume of 0.15–0.40 ml/g and a specific surface area of 200–800 $m^2$/g.

21. The process for producing diesel oils according to claim 1, wherein said hydrodewaxing catalyst has a $NH_3$-TPD acid distribution as follows:

160° C.: 0.150–0.185 mmol/g;
250° C.: 0.115–0.145 mmol/g;
350° C.: 0.060–0.105 mmol/g;
450° C.: 0.045–0.065 mmol/g; and
530° C.: 0.005–0.020 mmol/g.

22. The process for producing diesel oils according to claim 1, wherein said hydrorefining step, hydroupgrading step and said hydrodewaxing step are carried out respectively on three beds of one or two reactors, or in three reactors combined in series.

* * * * *